US007016501B1

(12) United States Patent
Aylward et al.

(10) Patent No.: US 7,016,501 B1
(45) Date of Patent: Mar. 21, 2006

(54) DIRECTIONAL DECODING

(75) Inventors: J. Richard Aylward, Ashland, MA (US); Hilmar Lehnert, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/313,058

(22) Filed: May 17, 1999

Related U.S. Application Data

(63) Continuation-in-part of application No. 08/796,285, filed on Feb. 7, 1997, now Pat. No. 6,711,266.

(51) Int. Cl.
*H04R 5/00* (2006.01)

(52) U.S. Cl. ..... 381/22; 381/23; 381/56

(58) Field of Classification Search ..... 381/1, 381/17, 18, 19, 22, 23, 97, 56, 11, 12
See application file for complete search history.

(56) References Cited

U.S. PATENT DOCUMENTS 4,192,969 A * 3/1980 Iwahara ..... 381/1
4,799,260 A * 1/1989 Mandell et al. ..... 381/22
4,941,177 A * 7/1990 Mandell et al. ..... 381/22
4,984,273 A * 1/1991 Aylward et al. ..... 381/1
5,046,098 A 9/1991 Mandell et al.
5,272,756 A * 12/1993 Tanaka et al. ..... 381/12
5,426,702 A * 6/1995 Aarts ..... 381/27
5,572,591 A * 11/1996 Numazu et al. ..... 381/1
5,671,287 A * 9/1997 Gerzon ..... 381/17
5,727,068 A * 3/1998 Karagosian et al. ..... 381/22
6,711,266 B1 * 3/2004 Aylward ..... 381/22
6,721,425 B1 * 4/2004 Aylward ..... 381/22

FOREIGN PATENT DOCUMENTS

EP 0 593 128 A 4/1994
JP 01 144900 A 6/1989
JP 5-236599 A 9/1993
JP 05 236599 A 12/1993

* cited by examiner

*Primary Examiner*—Xu Mei
(74) *Attorney, Agent, or Firm*—Fish & Richardson P.C.

(57) ABSTRACT

The degree of correlation between two audio signals is determined and the channels are normalized according to first and second normalization modes responsive to correlation and uncorrelation respectively.

21 Claims, 10 Drawing Sheets

Flow diagram representing signal pre-mixer in combination with an "n" channel directional decoder where "n" ≤ 5

DIRECTIONAL DECODING

This application is a continuation-in-part of of U.S. application Ser. No. 08/796,285 filed Feb. 7, 1997 now U.S. Pat. No. 6,711,266, entitled Surround Sound Channel Encoding and Decoding, now issued as U.S. Pat. No. 6,711,266, the entire disclosure of which is incorporated herein by reference.

The invention relates to the decoding of audio signals into directional channels, and more particularly to novel apparatus and methods for decoding input channels into cardinal output channels. For background reference is made to that application and its background.

It is an important object of the invention to provide an improved method and apparatus for decoding audio signals into multiple output channels.

According to the invention, a method for processing multichannel audio signals includes determining the degree of correlation of two of the channels, and normalizing the channels according to first and second normalization modes; in response to determining that the two channels are correlated and uncorrelated, respectively.

In another aspect of the invention, a method for processing multichannel audio signals includes determining the degree of correlation of two of the channels and responsive to a determining that the two channels are partially correlated and partially uncorrelated, processing the channels according to a combination of a first normalization mode and a second normalization mode.

In another aspect of the invention, a method for decoding an encoded multichannel audio signal includes determining the correlation of a first channel and a second channel and processing the first channel and the second channel to produce a third channel and a fourth channel.

In still another aspect of the invention, an apparatus for processing multichannel audio signals, includes an input characteristics determiner for determining a degree of correlation of two of the channels; a first normalizing multiplier, coupled to the input characteristics determiner, for applying a first normalizing coefficient to a first of the two channels, the normalizing coefficient being responsive to the degree of correlation; and a second normalizing multiplier, coupled to the input characteristics determiner, for applying a second normalizing coefficient to the second signal, the normalizing coefficient being responsive to the degree of correlation.

Other features, objects, and advantages will become apparent from the following detailed description, which refers to the following drawings in which.

Figure 1:
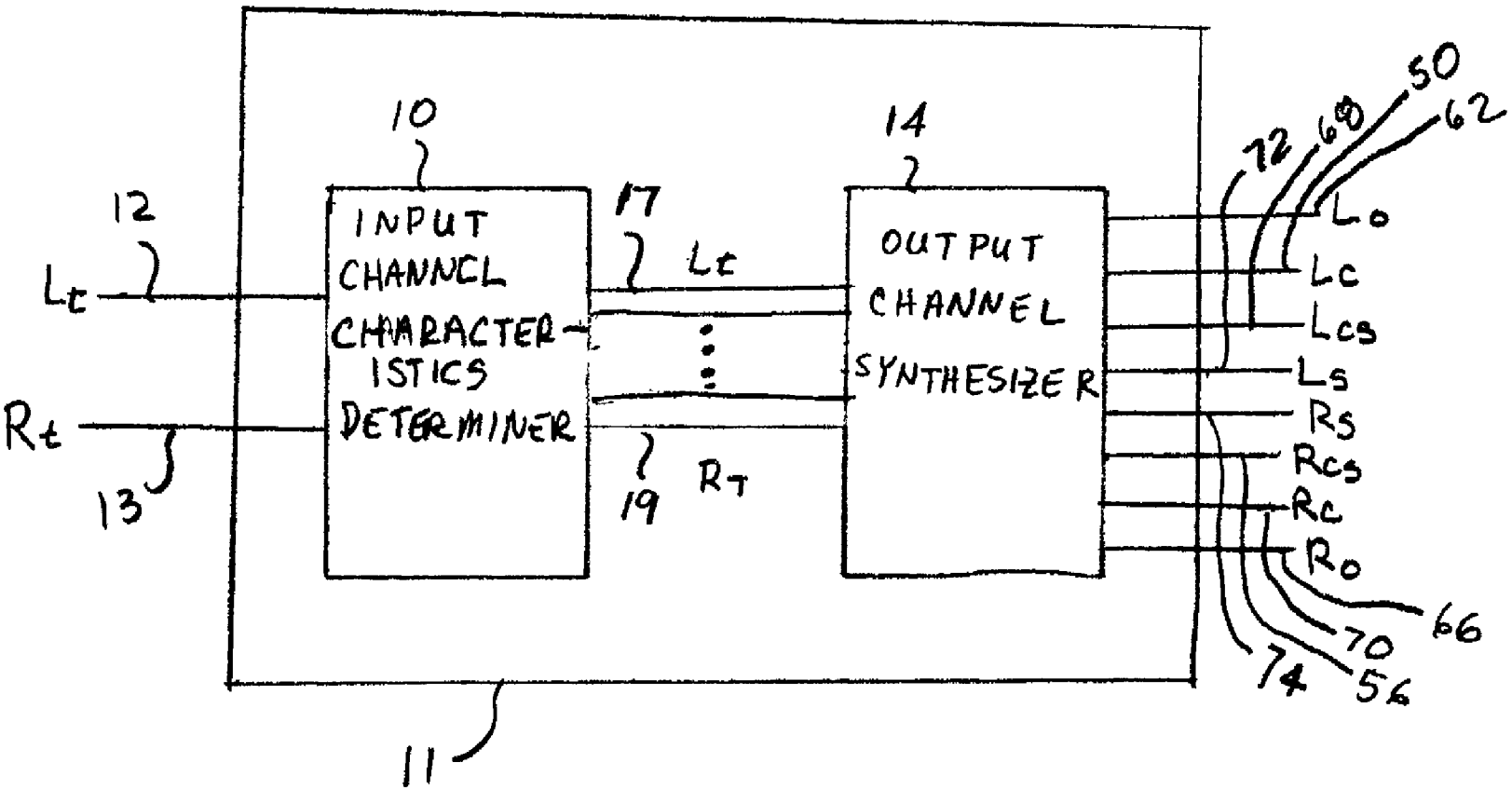
FIG. 1 is a block diagram of an audio signal processing system.

Referring now to FIG. 1, there is shown a two-input channel, eight-output channel wideband directional decoding audio signal processing system 1 according to the invention. Input channel characteristics determiner 10 is adapted to receive an audio signal from input channels 12, 13 (identified as left input channel Lt 12 and right input channel Rt 13) from a signal source such as a receiver, VCR, or DVD player. Input channel characteristics determiner 10 is adapted to transmit inputs on channels 12, 13 (by signal lines 17, 19), and to transmit other signals as will be described in the discussion of FIG. 3, to output channel synthesizer 14. Output channel synthesizer 14 is adapted to synthesize output signals on output channels 50, 56, 62, 66, 68, 70, 72, 74.

A "channel" as used herein, refers to audio information that is encoded in such a manner that it can be decoded or processed or both and reproduced at a location relative to a listener, so that the listener perceives the sound as originating from a direction in space. Input channels may be encoded in such a way that they can be decoded into more than one output channel, or so that the total number of output channels is greater than the total number of input channels. Output channels are typically designated by a directional designator, such as "left," "right," "center," "surround," "left surround" and "right surround," depending on the direction from which it is intended the sound is perceived to come. For purposes of explanation, input channels 12, 13, and output channels 50, 56, 62, 66, 68, 70, 72, 74 are shown as separate elements. The number of input channels is not necessarily the same as the number of physical signal lines that transmit the information in the channels. Digital signal transmission systems, typically have one signal line for transmitting several input channels. Input channels are typically encoded as analog electrical signals or as digital bitstreams.

"Presentation channels" refer to channels that are available for decoding or reproduction, and "reproduction channels" refer to the channels which have been decoded and which are intended for reproduction by a device such as a loudspeaker.

The information in the output channels may be in a "cardinal" state if information in the output channel is exclusively and uniquely associated with that output channel associated direction. Stated differently, if the information in the output channel contains only information for that output channel associated direction and no other output channel contains information for that output channel associated direction, that output channel is in a cardinal state and the associated direction is a cardinal direction. So, for example, if the left surround channel contains only left surround signal content and if no other channels contains left surround signal content, the left surround channel is said to be in a cardinal state, the left surround direction is said to be a cardinal direction, and a location in the cardinal direction relative to a listener is said to be a cardinal location.

Figure 2:
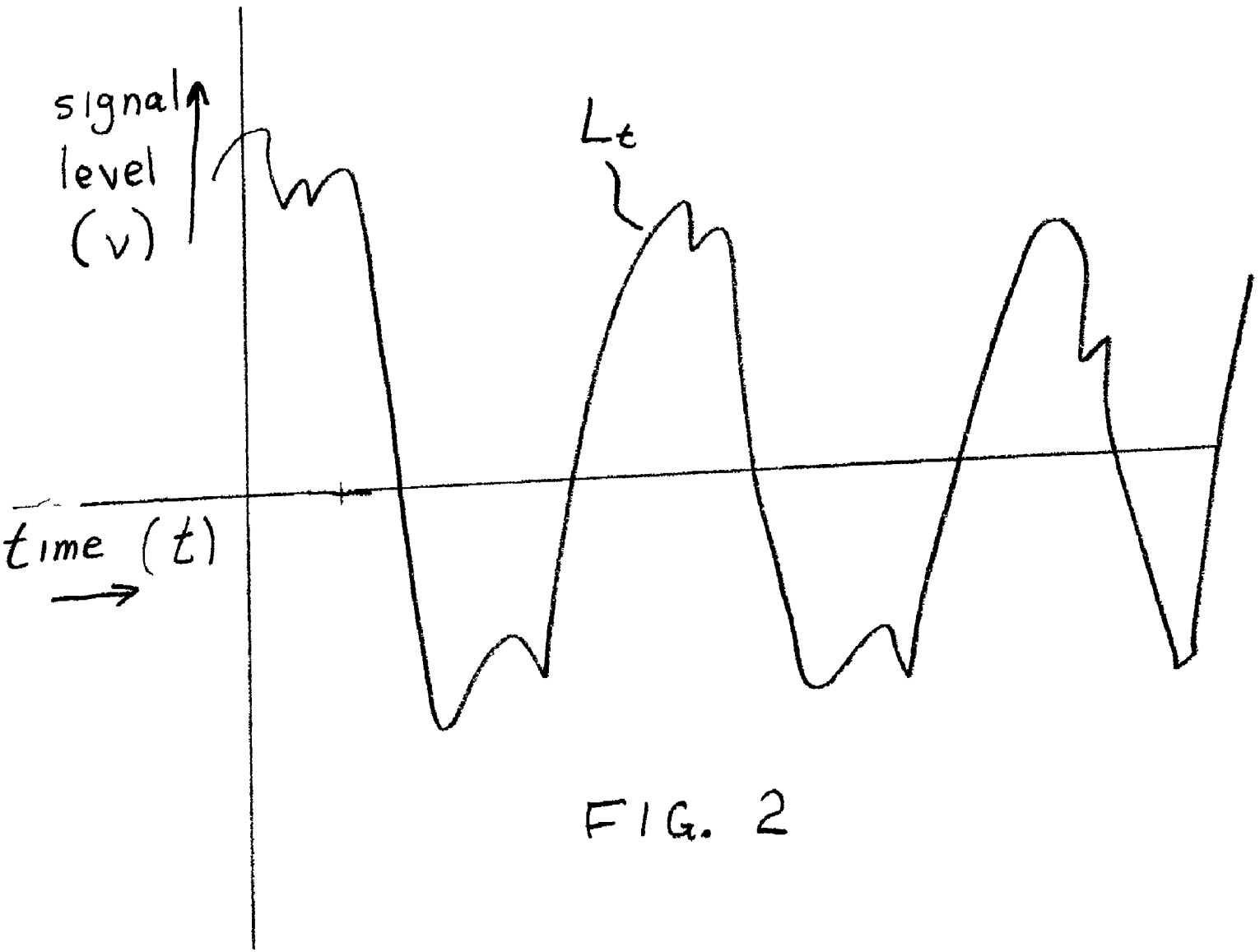
FIG. 2 is a representation of an audio signal, helpful in explaining characteristics of the audio signal.

Referring now to FIG. 2, there is shown an example of input channel information. In FIG. 2, input channel information is encoded as a signal level, typically measured in volts v with respect to time t. For ease of explanation, the signal level in a channel (for example input channel Lt) will be referred in the equations as Lt. Similarly, for example, the time-averaged values of the signal level in a channel (for example input channel Rt) will be referred to as $|\overline{Rt}|$, the difference of the signal level in channels Lt and Rt will be referred to as Lt−Rt, the time averaged values of the sum of the signal levels will be referred to as $$\overline{Lt+Rt},$$

and the absolute value of the time-averaged difference of the signal levels in channels Lt and Rt will be represented as $$\overline{|Lt-Rt|},$$

and similar references to other signals. A typical time averaging interval is about 5 ms to about 1000 ms. The length of the time averaging interval is discussed below connection with FIG. 3. Input channel information may also be encoded digitally as a bitstream of signal levels measured at time intervals.

Figure 3:
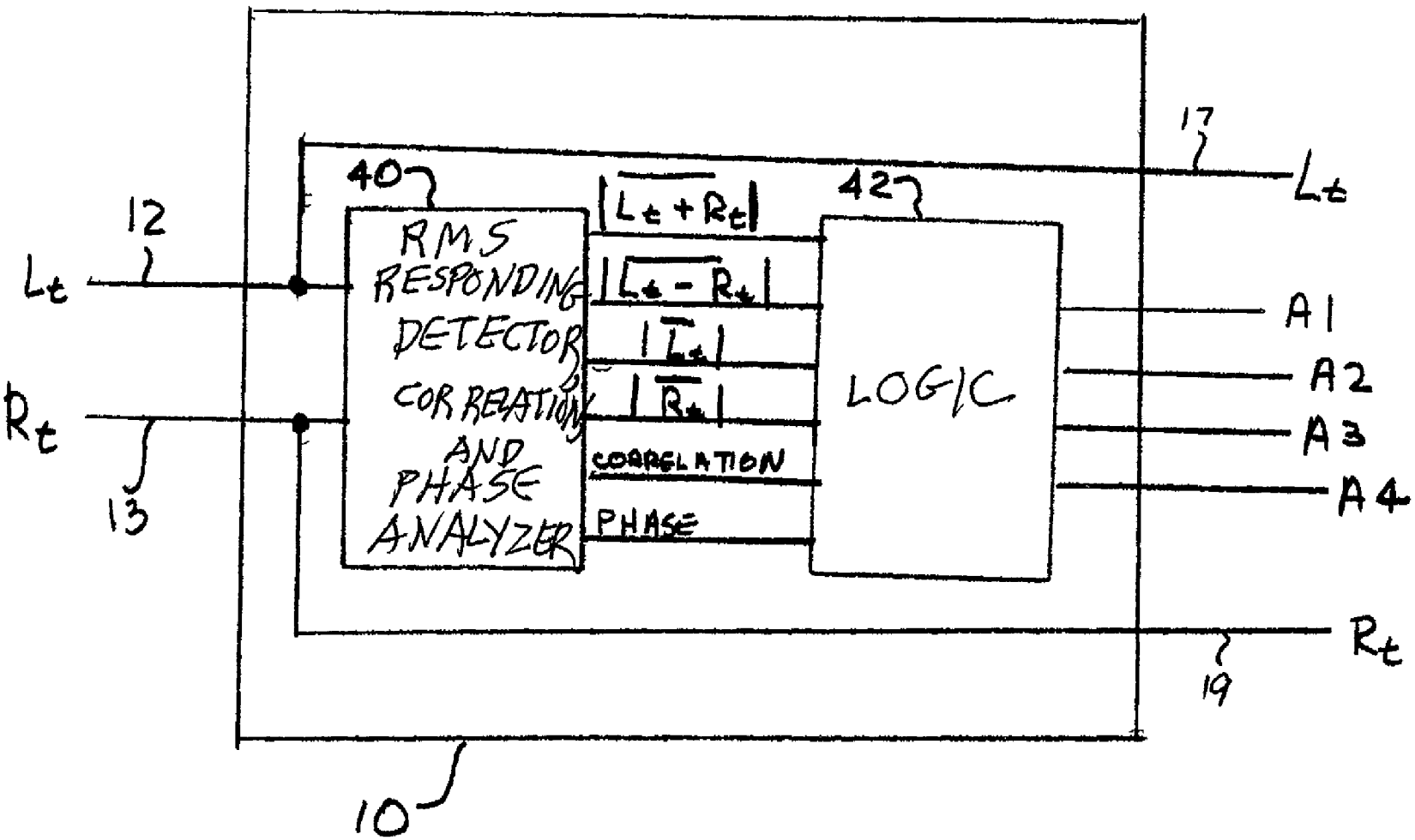
FIG. 3 is a block diagram of an input characteristics determiner according to the invention.

Referring now to FIG. 3, there is shown input channel characteristics determiner 10 in more detail. Input channels Lt 12 and Rt 13 are inputted into RMS responding level detector and correlation and phase analyzer 40 which generates the following time averaged signal quantities:

$$\overline{|Lt+Rt|} \quad (1)$$

$$\overline{|Lt-Rt|} \quad (2)$$

$$\overline{|Lt|} \quad (3)$$

$$\overline{|Rt|} \quad (4)$$

The quantities are fed to logic 42, which derives a quantity X that is the larger of either (1) or (2), and derives a quantity Y that is the larger of (3) or (4). Signal quantities (1) and (2) are combined with signal quantities (3) and (4), along with quantities Y and X to construct normalization coefficients A1, A2, A3, and A4. The specific combinations of quantities (1), (2), (3), and (4), and quantities X and Y used to construct A1, A2, A3, and A4 are dependent on correlation and phase relationship information as determined by RMS responding level detector and correlation and phase analyzer 40. If the input channels Lt and Rt are correlated (a condition hereinafter referred to as "panned mono") the values of A1, A2, A3, and A4 are:

$$A1 = \frac{\overline{|Lt+Rt|} - |Lt|}{Y}\{0, 1\}$$

$$A2 = \frac{\overline{|Lt-Rt|} - |Lt|}{Y}\{0, 1\}$$

$$A3 = \frac{\overline{|Lt-Rt|} - |Rt|}{Y}\{0, 1\}$$

$$A4 = \frac{\overline{|Lt+Rt|} - |Rt|}{Y}\{0, 1\}$$

The domains of all normalization coefficients are from 0 to 1 inclusive. Thus, for the condition of sum signal dominance, normalization coefficients (A2) and (A3) evaluate to zero. Similarly, for the condition of difference signal dominance, normalization coefficients (A1) and (A4) evaluate to zero.

The normalization coefficients applied to the signals in channels Lt and Rt are different. In the case of normalization coefficients A1 and A2, the normalization coefficient is responsive to the sum or difference of the two signals and the magnitude of Lt, while in the case of normalization coefficients A3 and A4, the normalization coefficient is responsive to the sum or difference of the two signals and the magnitude of Rt. A normalization mode of this type, which applies different normalization coefficients to the input signals, will be referred to as a "differential mode."

In one embodiment, the time averaging interval may be adaptive to the contents of the input signals as determined by correlation and phase analyzer 40. If the input signals are uncorrelated, the averaging interval may be relatively long (for example about 1000 ms). If the input signals are correlated; that is, have similar waveforms, the time intervals may be short (for example about 5 ms). If the magnitude of the signals is relatively small, the time averaging interval may be short. The time averaging interval may be short if both of the input signals are close to zero. If the difference of the magnitude of the signals is large (for example if $|Lt-Rt| \geqq 20$ dB), the time averaging interval may be short. A common method of implementing time averaging intervals is to measure the signal periodically and weight each measurement exponentially less than the preceding measurement. Using this measurement, the averaging interval is typically expressed as the period of time it takes for the weighting of the measurement to decline to some fraction, such as ⅓ of the weighting of the most recent measurement.

Figure 4:
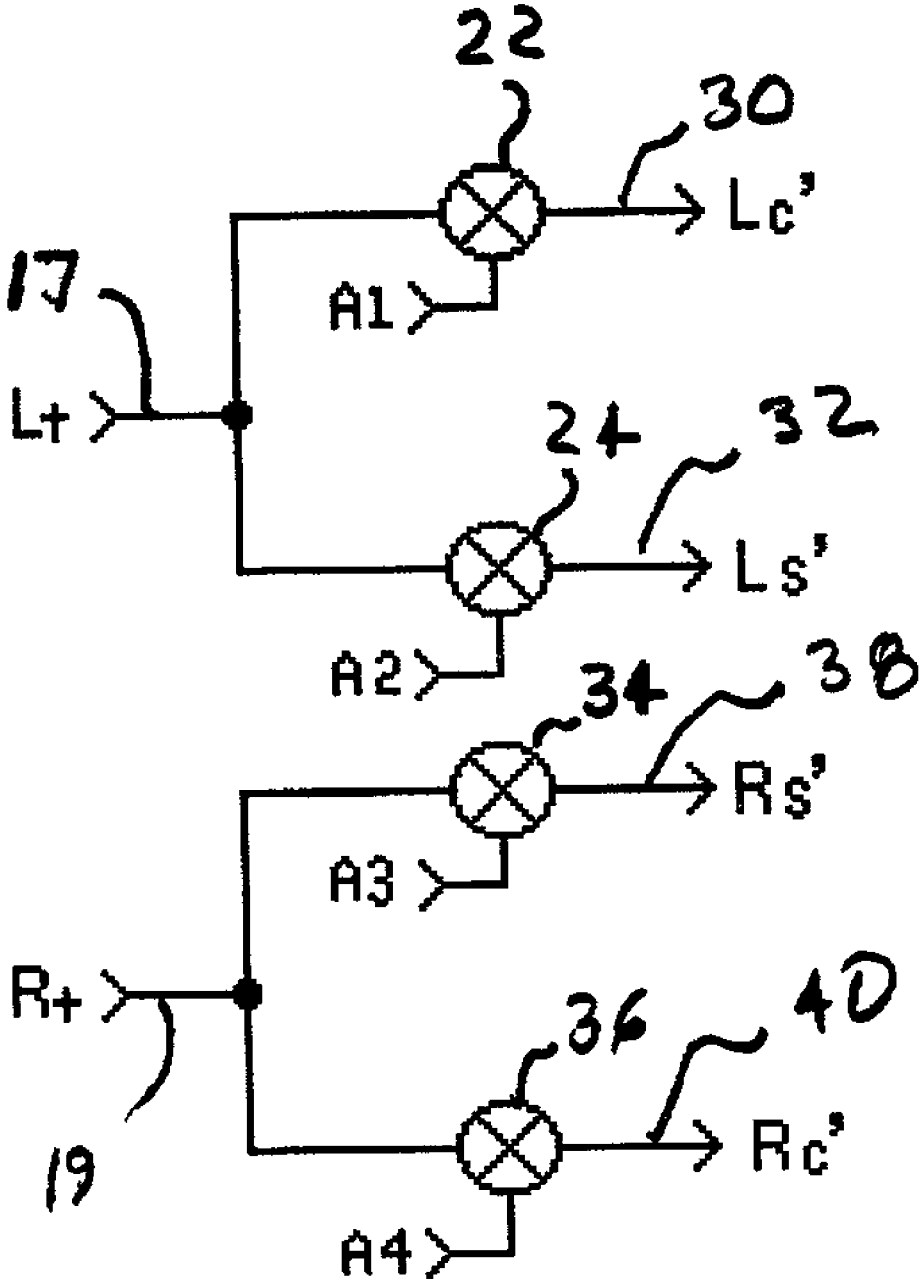
FIG. 4 is a first portion of the circuitry of an output channel synthesizer according to the invention.

Referring now to FIG. 4, there is shown a first portion of the circuitry of output channel synthesizer 14. Lt input channel 17 is fed multipliers 22 and 24, respectively, to form post-normalization channels Lc' 30 and Ls' 32 respectively, Similarly, Rt input channel 19 is fed to multipliers 34 and 36, where it is multiplied by normalization coefficients A3 and A4, respectively, to form post-normalization channels Rs' 38 and Rc' 40, respectively.

If input signals at Lt and Rt are correlated and are further constrained to be either in phase, or phase shifted by a 180 degree relative phase difference, the contribution from Lt to Lc' (or Ls'), is equal (in magnitude) to the contribution from Rt to Rc' (or Rs'), independent of the relative amplitude difference (if any) imposed at the input terminals Lt and Rt. Furthermore the contribution from Lt to Lc' (or Ls') and Rt to Rc' (or Rs') is equal to the lesser of the two input signal amplitudes at Lt and Rt. The resulting normalized output signals at (A1) through (A4) are equal amplitude monaural contributions from Lt and Rt which are directionally identified as center channel or center surround channel components. If the input conditions at Lt and Rt are considered to include both a center channel signal and a surround channel signal, but produce either a sum signal dominant or difference signal dominant condition, the normalization function is singularly responsive to the dominant condition. Accordingly, sum dominant normalized signals appearing at the outputs of (A1) and (A4) can contain a nondominant surround channel signal. Likewise, difference dominant normalized signals appearing at the outputs of (A2) and (A3) can contain a nondominant center channel signal. The surround channel signal, which is present at the outputs of (A1) and (A4) during a sum signal dominant condition, is retrieved by subtracting the output of (A4) from (A1). The surround channel signal is identified as containing a 180 degree relative phase difference at input terminals Lt and Rt. Similarly, the center channel signal appearing at the outputs of (A2) and (A3) during a difference dominant condition, is retrieved by summing the output of (A3) with (A2). The center channel signal is identified as being the in-phase signal appearing at input terminals Lt and Rt.

The normalization function illustrated in FIG. 4 has an important characteristic. If the input signals at Lt and Rt contain a dominant center channel signal and simultaneously contain uncorrelated unequal amplitude signals, (such that Lt or Rt is in a condition of dominance) the normalized Lt and Rt signal contributions at the outputs of (A1) and (A4) will not contain equal amplitude contributions of the Lt and Rt input signals, but rather, equal magnitude contributions of the normalized Lt and Rt input signals. Subtracting the output of (A4) from (A1) to retrieve a surround channel signal in the presence of a sum signal dominant condition and an Lt or Rt dominant condition will introduce a portion of the center channel signal into the surround channel. Adding the outputs of (A2) and (A3) to retrieve a center channel signal in the presence of a difference dominant input condition at Lt and Rt during an Lt or Rt dominant input condition, will introduce a portion of the surround channel signal into the center channel. Thus, a differentially based normalization function is especially desirable when the input conditions at Lt and Rt are panned mono. However, it is desirable to adapt the normalization function to the input signal conditions at Lt and Rt whenever the inputs are other than panned mono.

Another feature of the invention is that the invention includes a method for providing an improved normalization mode for instances in which contents of Lt and Rt are other than panned mono. Referring again to FIG. 3, if RMS responding level detector and correlation and phase analyzer 40 detects that the signals at Rt and Lt are uncorrelated, logic 42 outputs the following values for A1, A2, A3, and A4:

$$A1 = \frac{\overline{|Lt + Rt|} - Y}{Y}\{0, 1\}$$

$$A2 = \frac{\overline{|Lt - Rt|} - Y}{Y}\{0, 1\}$$

$$A3 = \frac{\overline{|Lt - Rt|} - Y}{Y}\{0, 1\}$$

$$A4 = \frac{\overline{|Lt + Rt|} - Y}{Y}\{0, 1\}$$

These normalization coefficients are formed by taking the signal quantities (1) and (2) in combination with the Y variable and do not include the signal quantities $\overline{|Lt|}$ and $\overline{|Rt|}$.

These normalization coefficients are formed by taking the signal quantities (1) and (2) in combination with the Y variable, which is common to the normalization coefficients applied to both Lt and Rt, and which do not include the signal quantities $\overline{|Lt|}$ and $\overline{|Rt|}$. A normalization mode of this type, which applies a common normalization coefficient to the input signals will be referred to as a "common mode."

The time averaging intervals may vary, as in the discussion above.

The substitution of the Y variable for signal quantities (3) and (4) into normalization coefficients (A1) through (A4) transform normalization coefficients (A1) through (A4) from differential mode to common mode. When the signals in input channels Lt and Rt are uncorrelated, the value of A1 for any assumed Lt and Rt input conditions will be equal to the value of A4. Likewise, the value of A2 will also be equal to the value of A3.

Referring now to FIG. 4, and using the new values of A1–A4, the previous input signal conditions at Lt and Rt, wherein Lt or Rt is dominant and simultaneously contain a dominant center channel signal, now produce equal center channel signal contributions from Lt and Rt at the outputs of A1 and A4. Subtracting the output of A4 from A1 no longer introduces a center channel signal into the surround channel. Further, adding the output of A2 to A3 will not introduce a surround channel signal into the center channel if the input signals at Lt and Rt contain a dominant surround channel signal with an attending Lt or Rt dominant signal. Thus a common-mode based normalization function is desirable whenever the input signals at Lt and Rt are uncorrelated. Normalization coefficients (A1) through (A4) can now be linked when the signals in input channels Lt and Rt are correlated with the values of (A1) through (A4) when the signals in input channels Lt and Rt are uncorrelated to form transform coefficient (A7), and further define transform coefficient A7 as:

$$A7 = \frac{X - \sqrt{Lt^2 + Rt^2} + \varepsilon}{Lt - Rt - \sqrt{Lt^2 + Rt^2} + \varepsilon}$$

and operator A8 as:

$$A8 = \frac{Lt + Rt + \varepsilon}{X + \varepsilon}$$

where e is an arbitrary number, much smaller than any of the other quantities, inserted so that if the remaining terms of the denominator evaluate to zero, the circuit will not attempt to divide by zero.

Normalization coefficients (A1) through (A4) can now be generalized as:

$$A1 = \left(A8 \cdot \frac{|Lt - Rt| - A7Lt - (1 - A7)Y}{Y + \varepsilon} - u(|Lt - Rt| - |Lt + Rt|) \cdot A7 \cdot \left(1 - \frac{2L}{Y + \varepsilon}\right)_{[0,1]}\right)_{[0,1]}$$

$$A2 = \left(A8 \cdot \frac{|Lt - Rt| - A7Lt - (1 - A7)Y}{Y + \varepsilon} - u(|Lt + Rt| - |Lt - Rt|) \cdot A7 \cdot \left(1 - \frac{2L}{Y + \varepsilon}\right)_{[0,1]}\right)_{[0,1]}$$

-continued $$A3 = \left(A8 \cdot \frac{|Lt - Rt| - A7Rt - (1 - A7)Y}{Y + \varepsilon} - u(|Lt + Rt| - |Lt - Rt|) \cdot A7 \cdot \left(1 - \frac{2R}{Y + \varepsilon}\right)_{[0,1]}\right)_{[0,1]}$$

$$A4 = \left(A8 \cdot \frac{|Lt - Rt| - A8Rt - (1 - At)Y}{Y + \varepsilon} - u(|Lt - Rt| - |Lt + Rt|) \cdot A7 \cdot \left(1 - \frac{2R}{Y + \varepsilon}\right)_{[0,1]}\right)_{[0,1]}$$

The generalized form of equations A1, A2, A3, and A4 is applicable to all degrees of correlation and phase. In the case of highly correlated signals, these generalized equations reduce to the differential mode normalization coefficients. In the case of the highly uncorrelated signals, these generalized equations reduce to the common mode normalization coefficients. In the case signals that are partially correlated, the generalized equations yield a result that has some differential content and some common content. A normalization of this type will be referred to a "complex mode."

Figure 5:
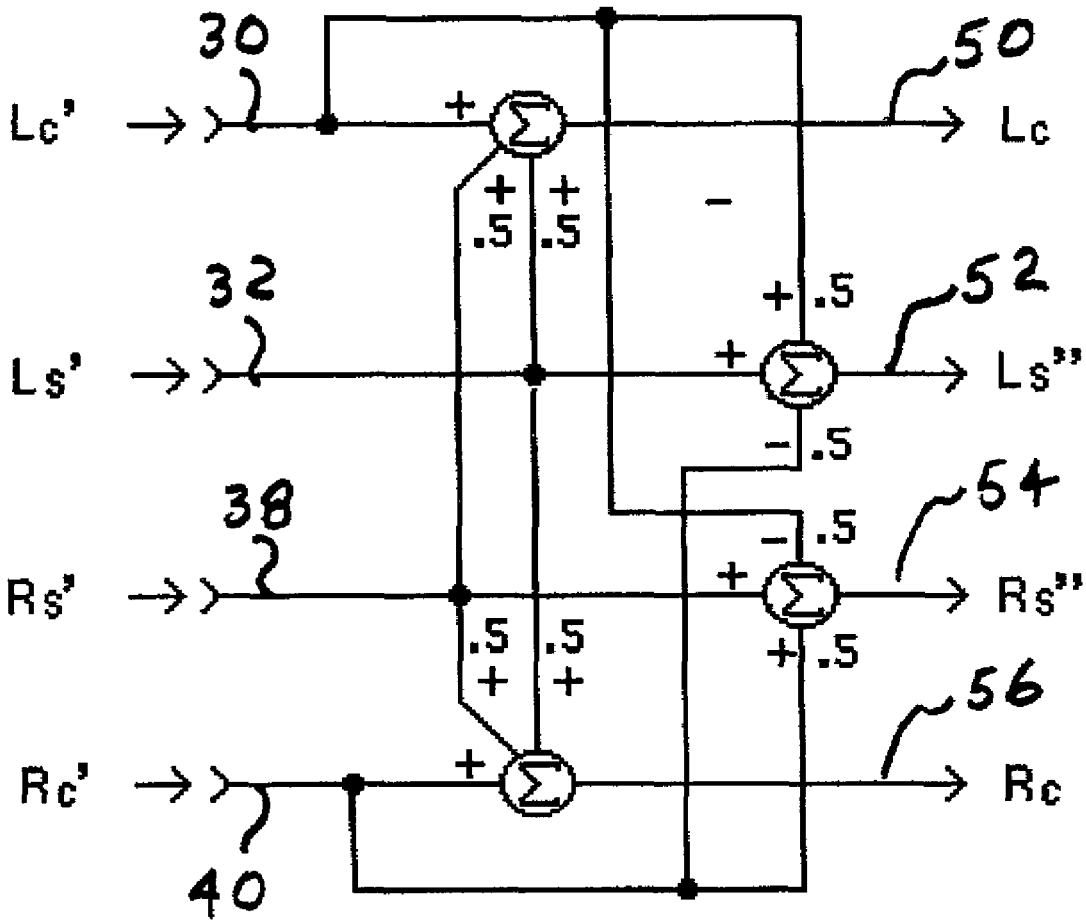
FIG. 5 is a second portion of the circuitry of an output channel synthesizer according to the invention.

Referring now to FIG. 5, there is shown a second portion of the circuitry of output channel synthesizer 14. The post-normalization channels of FIG. 4 are combined to produce interim channels Lc 50, Ls" 52, Rs" 54, and Rc 56 as $$Lc=Lc'+0.5(Ls'+Rs')$$

$$Rc=Rc'+0.5(Is'+Rs')$$

$$Ls''=Ls'+0.5(Lc'-Rc')$$

$$Rs''=Rs'+0.5(Rc'-Lc')$$

Putting the interim channels in terms of the normalization coefficients A1–A4 yields:

$$\mathrm{Lc}=\mathrm{Lt}(A1)+0.5\{Lt(A2)+Rt(A3)\}$$

$$Rc=Rt(A4)+0.5\{Lt(A2)+Rt(A3)\}$$

$$Ls''=Lt(A2)+0.5\{Lt(A1)-Rt(A4)\}$$

$$Rs''=Rt(A3)+0.5\{Rt(A4)-Lt(A1)\}$$

Figure 6:
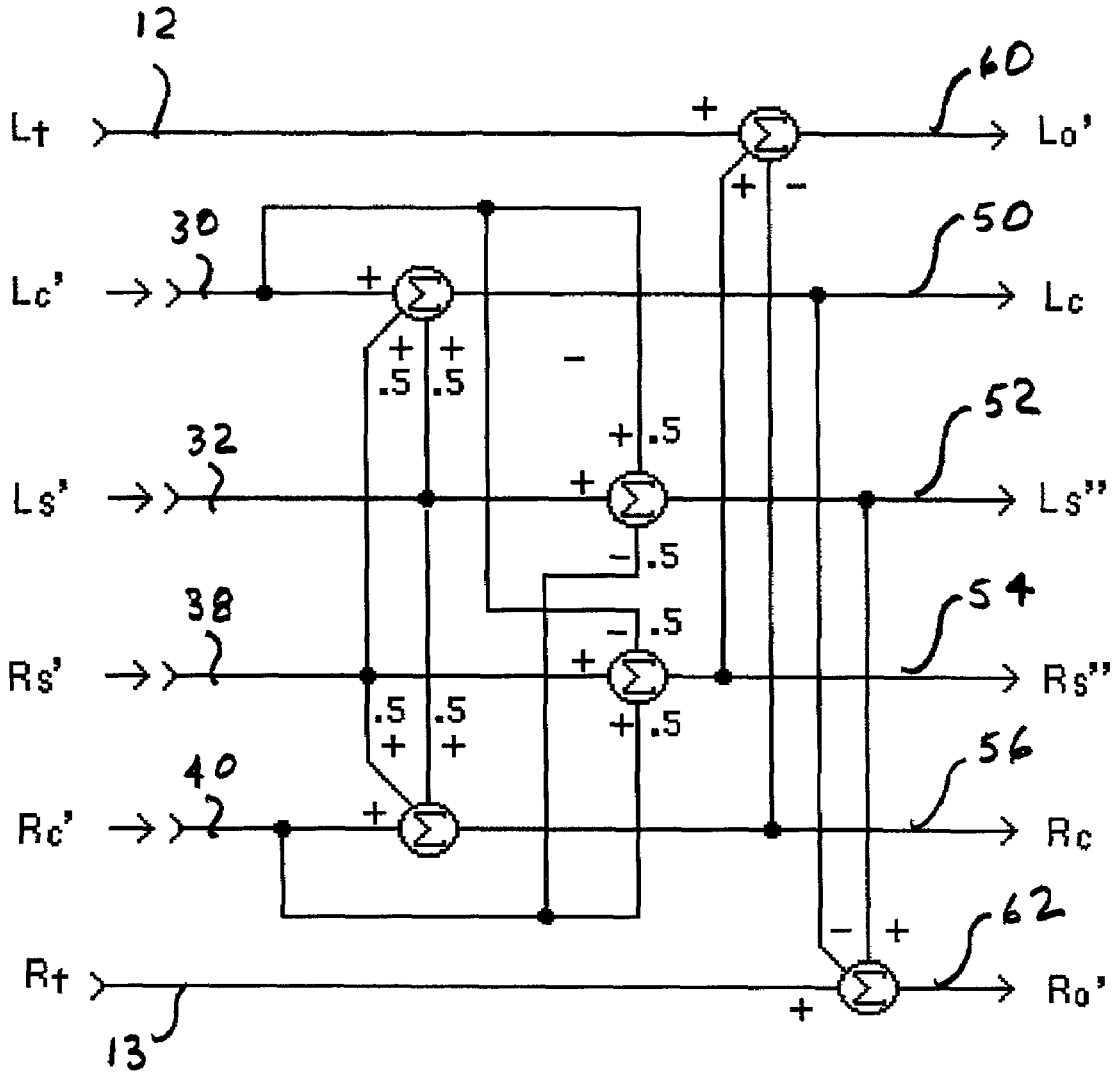
FIG. 6 is a third portion of the circuitry of an output channel synthesizer according to the invention.

Referring now to FIG. 6, there is shown the circuitry of FIG. 5, with the added interim channels Lo' 60 and Ro' 62 that at the outputs of combiners produce:

$$Lo'=Lt-Rc+Rs''$$

$$Ro'=Rt-Lc+Ls''$$

The normalization coefficients are singularly (and therefore exclusively) responsive to the dominant input signal condition at Lt and Rt. If the input signals at Lt and Rt are sum signal dominant, the input signals at Lt and Rt are correlated in-phase, and only normalization multipliers (A1) and (A4) are active. If the input signals at Lt and Rt are difference signal dominant, the input signals at Lt and Rt are correlated with a relative 180 degree phase shift, and only normalization multipliers (A2) and (A3) are active. If the input signals at Lt and Rt are uncorrelated (or in phase quadrature), the sum signal magnitude and the difference signal magnitude are equal, and all normalization multipliers (A1) through (A4) are active with the same numerical value.

The consequence of subtracting a correlated Rc signal from the Lt input is simply a reduction in the amplitude of the correlated in-phase (or center channel) signal at Lt. This does not reduce the amplitude of the uniquely left channel signal components, since Rc does not contain any uniquely left channel signal components. The amount of Rc signal removed from the Lt input is linearly dependant upon the relative degree of correlation between the Lt and Rt input signals. The same consequence exists when subtracting the Lc signal components from the Rt input. The amplitude of the correlated in-phase signal components at Rt are reduced in proportion to the degree of correlation between the Lt and Rt input signals.

The consequence of adding a correlated (but out-of-phase) Rs" signal to the Lt input is a reduction in the amplitude of the correlated but out-of-phase (or surround) channel signal at Lt. This does not reduce the amplitude of the uniquely left channel signal components, since the Rs" signal does not contain any uniquely left channel signal components. The amount of Rs" signal removed from the Lt input is linearly dependant upon the degree to which the Lt and Rt inputs are correlated, out-of-phase. The same consequence exists when adding out-of-phase correlated signal components in Ls" to Rt. The amplitude of the correlated out-of-phase signal components at Rt are reduced in proportion to the degree of correlation between the Lt and Rt input signals.

When the input signal conditions at Lt and Rt are uncorrelated, the matrix of terms Rs"–Rc and Ls"–Lc reduce (respectively) to:

$$-0.5\{(A1)+(A2)\}Lt \text{ and}$$

$$-0.5\{(A4)+(A3)\}Rt$$

Thus, the Lt and Rt input signals are respectively reduced by subtracting the normalized amplitude of Lt from Lt, and the normalized amplitude of Rt from Rt. This produces a corresponding reduction in the amplitudes of Lo' and Ro'.

Considering the nature of the signals Lc, Rc, Ls", and Rs", recall that $$Lc=Lc'+0.5(Ls'+Rs')$$

$$Rc=Rc'+0.5(Rs'+Ls')$$

$$Ls''=Ls'+0.5(Lc'-Rc)$$

$$Rs''=Rs'+0.5(Rc'-Lc')$$

Since Lc' and Ls' are components of the normalized Lt input, and Rc' and Rs' are components of the normalized Rt input, the Lc' signal cumulatively combines with the Ls' signal and the Rc' signal cumulatively combines with the Rs' signal. The normalization coefficient variables at (A1) through (A4) are numerically identical when the input signal conditions at Lt and Rt are uncorrelated in nature. For this condition, the Lt contribution to Lc and Ls" is dominant over the Rt contribution to Lc and Ls" by a factor of three, or approximately 10 dB. The Rt contribution to Rc' and Rs" is dominant over the Lt contribution to Rc' and Rs" by the same factor of three, or approximately 10 dB. As such, the Lc' and Ls" signals are substantially components of the normalized Lt input, and the Rc' and Rs" signals are substantially components of the normalized Rt input. If the Lc' and Rc' signals are respectively reproduced by separate loudspeakers placed to the left and right of center, the stereophonic content of the uncorrelated signals at Lt and Rt are substantially preserved. A signal processing system according to the invention reproduces the contributions from Lt to center and Rt to center as separate Lc and Rc signals, whenever separate center channel loudspeakers can be practically utilized in a reproduction system. This is advantageous over audio signal processing systems that derive a center channel signal from matrix encoded Lt and Rt stereophonic signals by summing a portion (or all) of the component signals at Lt and Rt. Recall that the normalization coefficient values of input normalization multipliers (A1) and (A4) are approximately zero whenever the input signals at Lt and Rt are difference signal dominant. The center channel signal which can be present at Lt and Rt during a condition of difference signal dominance is defined at Lc and Rc by:

$$Lc=0.5(Ls'+Rs')$$

$$Rc=0.5(Rs'+Ls')$$

For this condition of Lt and Rt input signal assumptions, Lc and Rc are identical. The summation of the signals Ls' and Rs' at Lc and Rc, respectively, force Lc and Rc to be monaural in nature. Summing the component signals of Lt and Rt at Ls' and Rs' to produce Lc and Rc ensures that the Lc and Rc signals do not contain the dominant surround channel signal. The content of Lc and Rc are largely stereophonic when the input conditions at Lt and Rt are uncorrelated or stereophonic, in nature, and that the content of Lc and Rc are monaural whenever the nature of the input signals at Lt and Rt are difference signal (or surround channel) dominant. Channels Lc and Rc are largely monaural in nature whenever the input signal conditions at Lt and Rt are substantially correlated.

The interim signals at Ls" and Rs" are similarly reduced whenever the input signal conditions at Lt and Rt are substantially sum signal (or center channel) dominant to:

$$Ls''=0.5(Lc'-Rc')$$

$$Rs''=0.5(Rc'-Lc')$$

The normalization coefficient values at input normalization multipliers (A2) and (A3) are approximately zero whenever the input signal conditions at Lt and Rt are sum signal (or center channel) dominant. The surround channel signal which may be present at Lt and Rt during a sum signal dominant condition is derived by subtracting the signal components of Rc' from Lc' to produce Ls" and similarly subtracting the signal components at Lc' from Rc' to produce Rs". Subtracting Rc' from Lc' to produce Ls" and Lc' from Rc' to produce Rs" ensures that Ls" and Rs" do not contain any center channel signal components whenever Lt and Rt are substantially sum signal (or center channel) dominant. The content of the interim signals Ls" and Rs" are largely stereophonic in nature whenever the input signal conditions at Lt and Rt are uncorrelated or substantially stereophonic in nature. The interim signals at Ls" and Rs" are substantially monaural in nature whenever the input signal conditions at Lt and Rt are substantially sum signal (or center channel) dominant. The stereophonic nature of the interim signals, Ls" and Rs" for uncorrelated input signals at Lt and Rt is advantageous over audio signal processing sytems that derive a monaural surround channel signal from matrix encoded stereophonic Lt and Rt signals by subtracting a portion (or all) of the Rt input signal from the Lt input signal.

The interim signals at Ls" and Rs", although largely stereophonic in nature when the input signal conditions at Lt and Rt are uncorrelated, do not exhibit exclusive cardinal states. The encoded Lt and Rt signals are such that an exclusive left surround channel signal or an exclusive right surround channel signal will respectively appear at Lt and Rt as:

Lt=Ls, Rt=−0.5(Ls) for exclusive left surround channel signal input

Rt=−Rs Lt=0.5(Rs) for exclusive right surround channel signal input. For exclusive left only or right only surround channel signals, the Lt or Rt encoded signals are such that a difference signal dominant condition is encoded with an attending Lt or Rt dominant condition. Furthermore, the encoded Lt and Rt signals are panned mono. An audio signal processing system according to the invention is advantageous because it can decode the given encoded Lt and Rt signal conditions as exclusive left only or right only surround channel signals.

Figure 7:
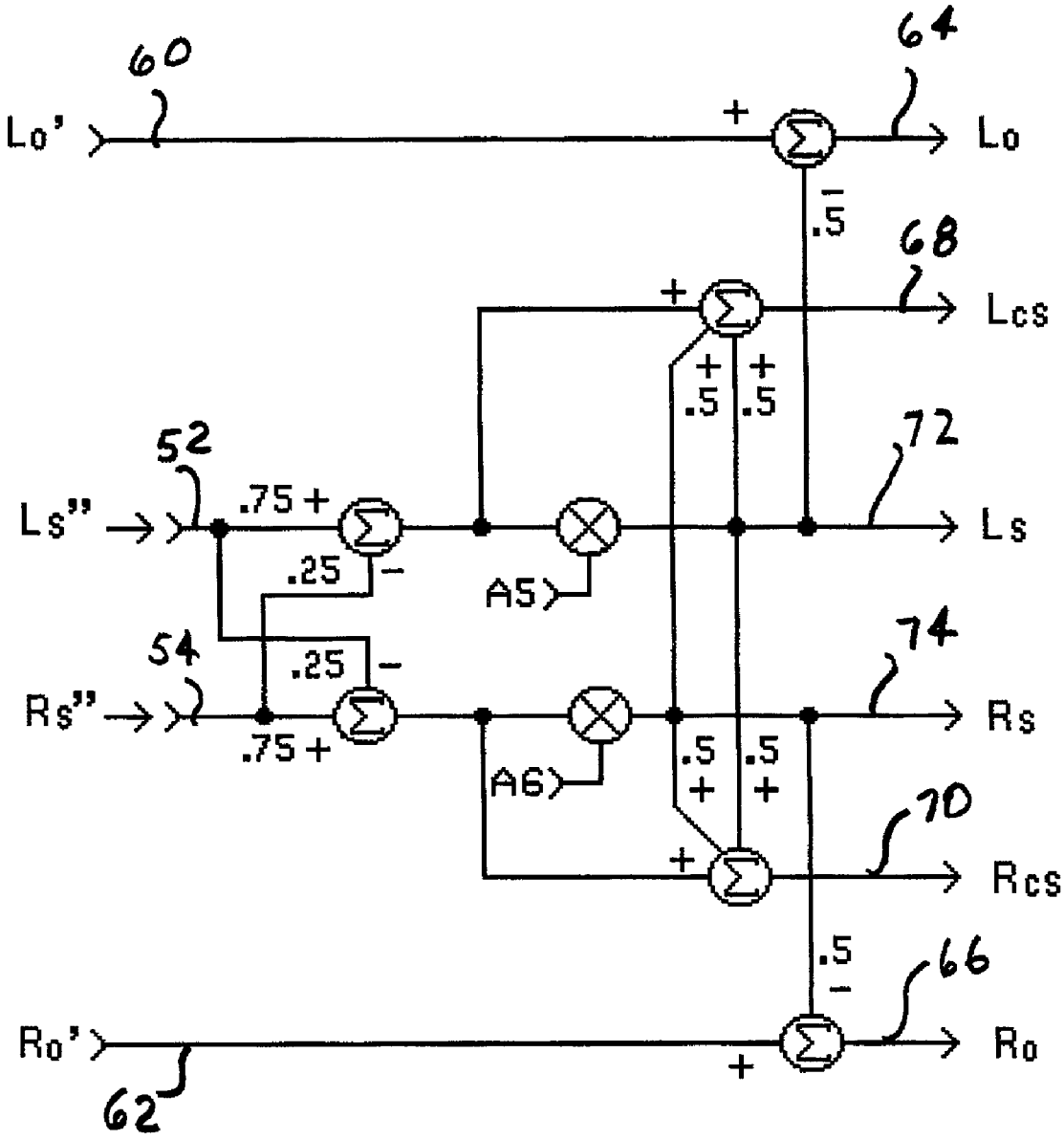
FIG. 7 is a fourth portion of the circuitry of an output channel synthesizer according to the invention.

Referring now to FIG. 7, there is shown another portion of channels synthesizer 14. Interim channels Ls" 52 and Rs" 54 signals are combined to form left front channel Lo 64, right front channel Ro 66, left center surround channel Lcs 68, right center surround channel Rcs 70, left surround channel Ls 72, and right surround channel Rs 74 according to:

$$Lo=Lo'-0.5(A5(0.75\,Ls''-0.25Rs''))$$

$$Ro=Ro'-0.5(A6(0.75Rs''-0.25Rs''))$$

$$Lcs=0.5(A5(0.75Ls''-0.25Rs''))+0.5(A6(0.75Ls''-0.25Rs''))+0.75Ls''-0.25Ls''$$

$$Rcs=0.5(A6(0.75Ls''-0.25Rs''))+0.5(A5(0.75Rs''-0.25Ls''))+0.75Rs''-0.25Ls''$$

$$Ls=A5(0.75Ls''-0.25Rs'')$$

$$Rs=A6(0.75Rs''-0.25Ls'')\text{ where}$$

$$A5=\left(A7\cdot\frac{Y-Rt}{Y+\varepsilon}\cdot\max\left(2,\frac{1}{\left(\frac{|Lt-Rt|-Y}{Y+\varepsilon}\right)_{[0,1]}+\left(\frac{|Lt+Rt|-Y}{Y+\varepsilon}\right)_{[0,1]}+\varepsilon}\right)\right)_{[0,1]}$$

$$A6=\left(A7\cdot\frac{Y-L}{Y+\varepsilon}\cdot\max\left(2,\frac{1}{\left(\frac{|Lt-Rt|-Y}{Y+\varepsilon}\right)_{[0,1]}+\left(\frac{|Lt+Rt|-Y}{Y+\varepsilon}\right)_{[0,1]}+\varepsilon}\right)\right)_{[0,1]}$$

The effect of the circuit of FIG. 7 is to re-matrix interim channels Ls" and Rs" with the normalization coefficients A5 and A6. The out-of-phase (or surround channel) signals cumulatively combine, whereas the in-phase (or center channel) signals differentially combine. Re-matrixing the Ls" and Rs" signals causes a corresponding reduction in amplitude of any center channel signal component which may be present in Ls" or Rs" during a difference dominant, uncorrelated input signal condition at Lt and Rt Although the process of re-matrixing the Ls" and Rs" signals further reduces the stereophonic content of Ls" and Rs", the contribution of Lt to Ls" is still dominant over the contribution of Rt to Ls". Likewise the contribution of Rt to Rs" is still dominant over the contribution of Lt to Rs". Thus the rematrixed Ls" and Rs" signals still retain a stereophonic characteristic when the signal conditions at Lt and Rt are substantially uncorrelated. With consideration to panned monaural, correlated out-of-phase input conditions at Lt and Rt, it is helpful to re-examine the nature of the signals Ls", Rs", Lo' and Ro'. The normalized contributions of Lt and Rt at Ls' and Rs" are substantially monaural in nature when the input signal conditions at Lt and Rt are correlated but out-of-phase, independent of the relative amplitudes of signals Lt and Rt. The normalized contributions of Lt and Rt at Ls" and Rs" are equal to the lesser of the two input signals Lt and Rt, whenever their relative amplitudes differ. Thus a correlated, difference dominant, Lt dominant input signal condition at Lt and Rt will result in contributions from Lt and Rt to Ls" and Rs" which are equal to the Rt input signal amplitude.

Since these signals are removed from Lt and Rt to produce interim signals Lo' and Ro' (as shown in FIG. 6), the Lo' interim signal contains the differential surround channel signal that was dominant in Lt. The same observation can be made of the interim signal Ro' for input signals at Lt and Rt which are correlated out-of-phase and Rt dominant. The outputs of multipliers (A5) or (A6) are equal in amplitude to the contribution of Lt or Rt at Ls" or Rs" which is a component of the originating encoded Ls or Rs input signal conditions. As such, all Lt dominant and difference signal dominant input signal conditions are defined as Ls dominant output signal conditions. Likewise, all Rt dominant and difference signal dominant input signal conditions are defined to be Rs dominant output signal conditions. The directionally cardinal Ls or Rs encoded signal conditions are decoded as cardinal Ls or Rs output signal conditions. In this regard, the decoder is the complement of the encoded signal conditions. It is also instructive to consider that the output signals at Ls and Rs are approximately zero whenever the encoded signals at Lt and Rt are equal amplitude signals. For this condition, the encoded signals are decoded to the Lcs and Rcs output terminals. In this regard, the decoded output signal conditions are the directional complement of the encoded signal conditions.

Figure 8:
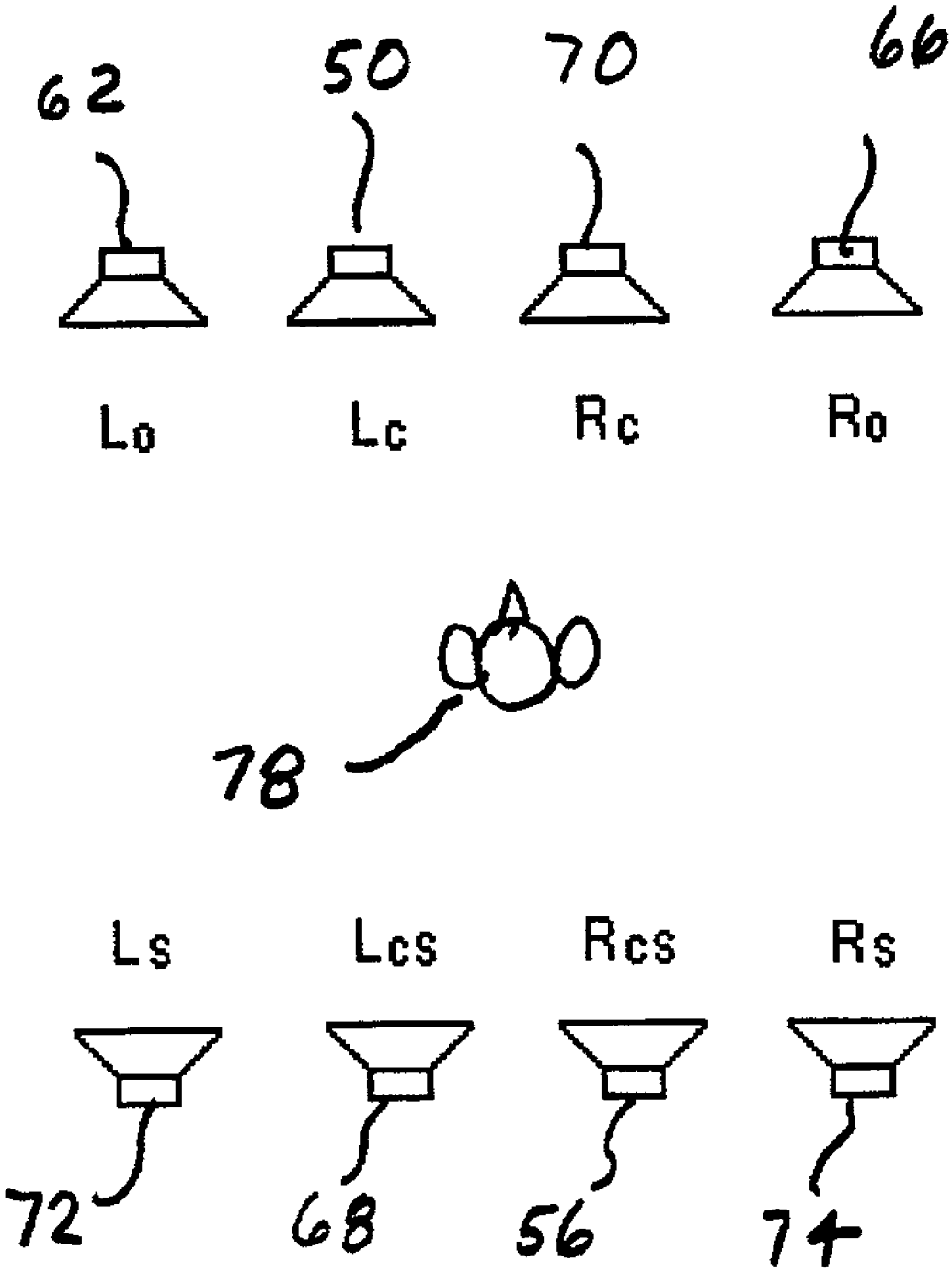
FIG. 8 is a diagram illustrating the placement of audio reproduction speakers coupled to outputs of an output channels synthesizer according to the invention.

Referring now to FIG. 8, the nature of the decoding method disclosed is such that a signal can be cardinally decoded to the following output terminals: Lo 62, Lc 50 Rc 70, Ro 66, Ls 72, Lcs 68, Rcs 56, Rs 74 placed relative to a listener 78 as indicated.

It is possible to decode matrix encoded Lt and Rt signals to six directionally cardinal locations in a 360-degree space. Interim directional locations are "phantom" sources based upon the presence of the decoded signal in multiple channels. For example, a signal can be encoded and subsequently decoded in a complementary manner, to appear at any point between the left channel output and left surround channel output. Likewise, a signal can be encoded and subsequently decoded in a complementary manner, to appear anywhere between the right output channel and right surround output channel. Thus a signal can be encoded and subsequently decoded to appear at any point within a 360-degree spatial angle.

The rendering of sources adjacent to the left or right side of a listener are more readily perceived when a physical reproduction channel exists at the prescribed spatial angle. The availability of a greater number of presentation channels, particularly in larger commercial venues such as motion picture theatres, which use a larger number of reproduction channels, takes special advantage of this aspect of the invention.

It is possible to utilize the greater number of reproduction loudspeakers in a commercial system to better advantage, by combining the pair-wise decoding technique disclosed in FIG. 17 and its description on page 16 of co-pending U.S. patent application Ser. No. 08/796,285 with the decoding technique now disclosed herein, such that the opposite channel information contained in either the matrix decoded Lt/Rt signals or the originating discrete media are processed to produce additional cardinal presentation channels adjacent to the left side and right side of an attending audience.

In many applications, it is not practical to employ as many as eight physical reproduction loudspeakers. Contemporary home reproduction systems are more typically configured with five physical reproduction loudspeakers. Furthermore, the introduction of 5.1 channel, discrete media presentation systems has defined the number of physical reproduction loudspeakers typically utilized. For reasons of convenience (i.e., a limited number of physical presentation loudspeakers and compatibility with discrete media presentation formats), it may be desirable to down-mix the number of decoded output channels of the disclosed algorithm for reproduction via five physical reproduction channels. This can be done by combining the channels as indicated:

$$C=0.707(Lc+Rc)$$

$$Ls=0.707(Lcs+Ls)$$

$$Rs=0.707(Rcs+Rs)$$

Down-mixing the decoded output channels does not reduce the number of cardinal directional states, but rather, the way in which the cardinal directions are reproduced. The cardinal Ls and Rs directional states are still retained. The stereophonic nature of the signals at Ls and Rs is likewise preserved. The exclusive Lcs/Rcs output condition is now reproduced as equal amplitude signals at Ls and Rs. Similarly, the Lc and Rc output signals appear at the single center channel output, thus retaining the cardinal center only direction.

Figure 9:
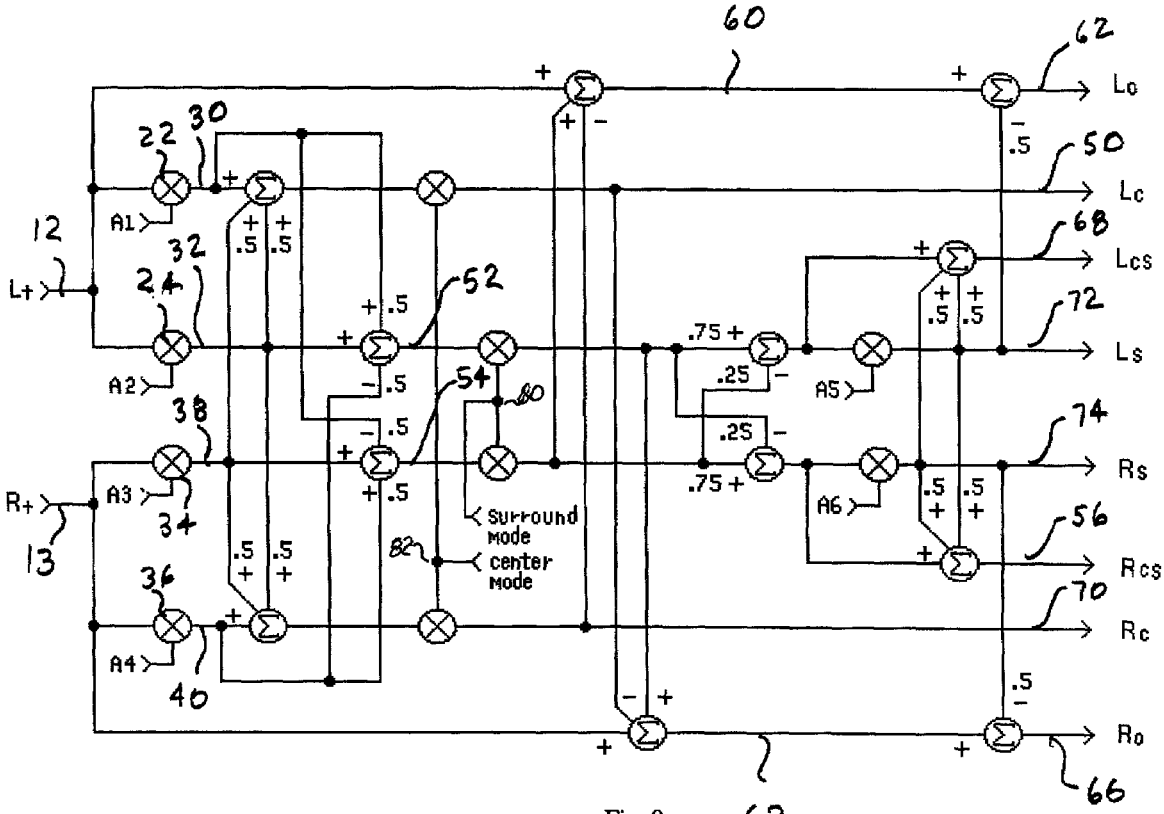
FIG. 9 is the combined circuitry of FIGS. 4–7.

Referring to FIG. 9, there is shown the combined circuits of FIGS. 3, 4, 5, 6, and 8. The composite block diagram of FIG. 9 is constructed from the individual block diagrams of FIGS. 4, 5, 6, and 7. Boolean switches 80 and 82 have been incorporated into FIG. 9 to enable or disable center channel decoding or surround channel decoding or both. When both sets of switches are in the off state, the input signals at Lt and Rt are presented at the Lo and Ro output terminals. Setting the surround channel mode switches to the off state, presents the surround channel signals at Lt and Rt to the Lo and Ro output terminals. Similarly, setting the center channel mode switches to the off state presents the center channel signals at Lt and Rt to the Lo and Ro output terminals.

In many instances, the number of provided reproduction channels are fewer than the number of available presentation channels. In these instances, it is advantageous to process the lesser number of reproduction channels such that the derived number of reproduction channels are equal to the number of available presentation channels. Moreover, contemporary signal transport formats convey as few as one channel or as many as five channels with an attending (spectrally limited) low frequency effects channel. In some signal transport formats, such as Dolby AC-3, information identifying the intended reproduction channel format are included as supplementary data within the transport format.

It is possible to utilize the supplementary data as a means of re-formatting the number of intended reproduction channels for further processing into the number of available presentation channels. The provided reproduction channel information is defined in terms of the number of front and rear (surround) reproduction channels. The most widespread formats are:

(1) three front channels two rear channels (stereo surround)

(2) two front channel two rear channels (no center channel)

(3) three front channels two rear channels (mono surround)

(4) two channels (stereo) (no center or surround channels)

(5) two channels Lt/Rt matrix encoded

It should be understood that other intended reproduction formats are possible, and it is likewise possible to process other intended reproduction formats using the techniques disclosed herein.

In all cases, it is desirable to process only the necessary channels to obtain the desired number of presentation channels. For all illustrations to follow, assume the number of presentation channels available to be five. As such, the Lcs, Rcs, Lc and Rc outputs of the decoding system shown in FIG. 9 are assumed to have been down-mixed as previously described. The number of available presentation channel signals, however, are not limited to five.

For format (1), the channels are processed discretely.

For format (2), only the provided left and right reproduction channels are processed as Rt and Lt to obtain a new left, right, and (the derived) center presentation channel signal(s). The originating surround channel signals of format (2) are not processed, and the surround channel mode switches 80 in the block diagram of FIG. 9 are set to the off state.

For format (3) the given channel format is first converted to a matrix format for processing. This is accomplished by first down-mixing the given monaural surround channel into the given left channel to form Lnew and further down-mixing (out-of-phase) the given monaural surround channel into the given right channel to form Rnew. Lnew and Rnew are subsequently input into the decoder to obtain new left, right, left surround and right surround presentation channels. The center channel mode switches 80 are set to the off state, since the originating center channel signal is not processed and is reproduced as given.

For formats (4) and (5), the given signals are input into the circuitry of FIG. 9, as Lt and Rt.

Figure 10:
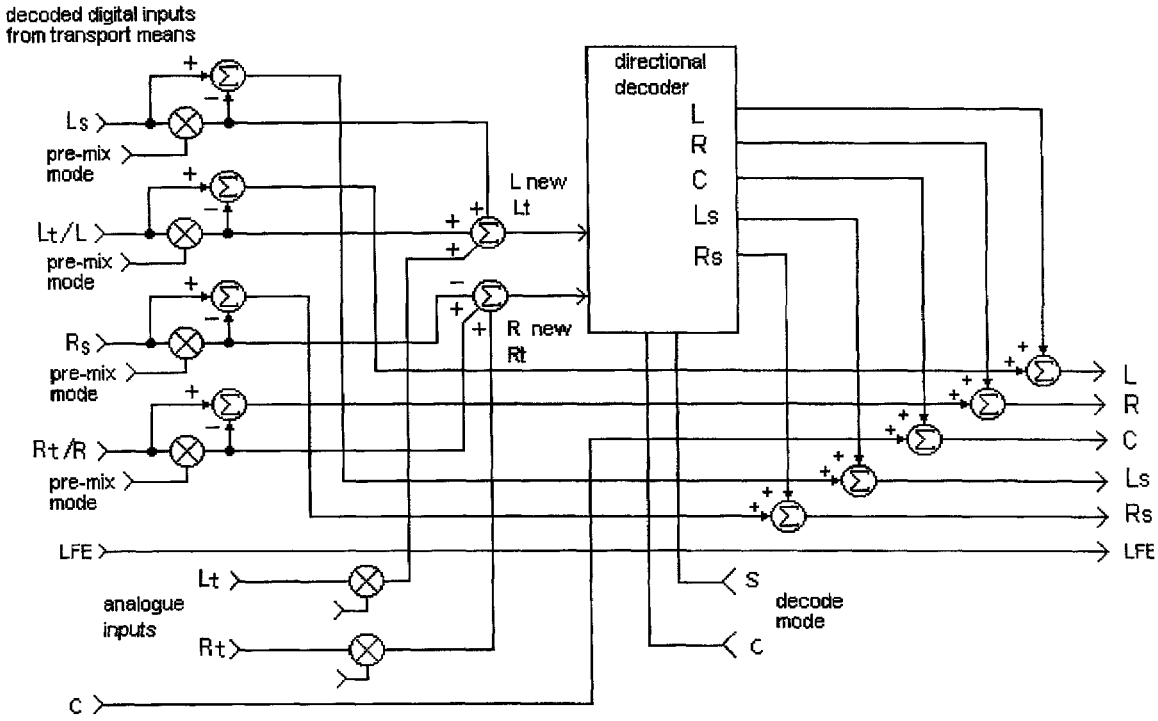
FIG. 10 is circuit illustrating the pre-processing of signals to the audio signal processing system.

The pre-processing for the various formats is summarized in FIG. 10.

Other embodiments are within the claims.

What is claimed is:

1. A method for processing multi-channel audio signals comprising a plurality of channels, the method comprising:

determining a degree of correlation between two of the plurality of channels, the degree of correlation being related to a waveform similarity between the two of the plurality of channels;

responsive to a determining that said two of the plurality of channels are correlated, normalizing said two of the plurality of channels according to a first normalization mode; and responsive to a determining that said two of the plurality of channels are uncorrelated, normalizing said two of the plurality of channels according to a second normalization mode.

2. A method for processing multi-channel audio signals in accordance with claim 1, wherein said first normalization mode is a differential mode.

3. A method for processing multi-channel audio signals in accordance with claim 2, further comprising determining the phase relationship of said two of the plurality of channels.

4. A method for processing multi-channel audio signals in accordance with claim 3, responsive to a determining that said two of the plurality of channels are substantially out of phase, said differential mode is difference signal dominant.

5. A method for processing multi-channel audio signals in accordance with claim 3, responsive to a determining that said two of the plurality of channels are substantially in phase, said differential mode is sum signal dominant.

6. A method for processing multichannel audio signals in accordance with claim 1, wherein said second normalization mode is a common mode.

7. A method for processing multi-channel audio signals in accordance with claim 6, further comprising the step of determining an absolute value of a sum signal of said two of the plurality of channels and an absolute value of a difference signal of said two of the plurality of channels.

8. A method for processing multi-channel audio signals in accordance with claim 7, responsive to a determining that said absolute value of said sum signal is greater than said absolute value of said difference signal, said common mode is sum signal dominant.

9. A method for processing multi-channel audio signals in accordance with claim 7, responsive to a determining that said absolute value of said difference signal is greater than said absolute value of said sum signal, said common mode is difference signal dominant.

10. A method for processing multi-channel audio signals comprising a plurality of channels, the method comprising:

determining a degree of correlation between two of the plurality of channels, the degree of correlation being related to a waveform similarity between the two of the plurality of channels; and responsive to a determining that said two of the plurality of channels are partially correlated and partially uncorrelated, processing said two of the plurality of channels according to a combination of a first normalization mode and a second normalization mode.

11. A method for processing multi-channel audio signals in accordance with claim 10, wherein said first normalization mode is a differential mode.

12. A method for processing multi-channel audio signals in accordance with claim 10, wherein said second normalization mode is a common mode.

13. A method for processing multi-channel audio signals in accordance with claim 10, wherein said combination is a linearly weighted combination of said first normalization mode and said second normalization mode.

14. A method for processing multi-channel audio signals in accordance with claim 13, wherein said first normalization mode is a differential mode and said second normalization mode is a common mode.

15. A method for decoding an encoded multi-channel audio signal comprising a plurality of channels, the method comprising:

determining a degree of correlation between a first channel and a second channel in the plurality of channels, the degree of correlation being related to a waveform similarity between the first channel and the second channel; and processing said first channel according to a first normalization mode and said second channel according to a second normalization mode to produce a third channel and a fourth channel.

16. A method for decoding an encoded multi-channel audio signal in accordance with claim 15, wherein responsive to a determining that said first channel and said second channel are substantially uncorrelated, said third channel and said fourth channel are substantially uncorrelated.

17. A method for decoding an encoded multichannel audio signal in accordance with claim 15, wherein responsive to a determining that said first channel and said second channel are substantially correlated, said third channel and said fourth channel are substantially correlated.

18. A method for decoding an encoded multichannel audio signal in accordance with claim 15, further comprising determining an absolute value of a sum of said first channel and said second channel.

19. A method for decoding an encoded multi-channel audio signal in accordance with claim 18, wherein, responsive to said absolute value of said sum signal being greater than said absolute value of said difference signal, said third channel and said fourth channel are substantially correlated.

20. A method for decoding an encoded multi-channel audio signal in accordance with claim 18, wherein, responsive to said absolute value of said difference signal being greater than said absolute value of said sum signal, said third channel and said fourth channel are substantially uncorrelated.

21. An apparatus for processing multi-channel audio signals comprising a plurality of channels, comprising:

an input characteristics determiner for determining a degree of correlation between two of the plurality of channels, the degree of correlation being related to a waveform similarity between the two of the plurality of channels;

a first normalizing multiplier, coupled to said input characteristics determiner, for applying a first normalizing coefficient to a first of said two of the plurality of channels, said first normalizing coefficient being responsive to said degree of correlation; and a second normalizing multiplier, coupled to said input characteristics determiner, for applying a second normalizing coefficient to a second of said two of the plurality of channels, said second normalizing coefficient being responsive to said degree of correlation.

* * * * *